US005619988A

United States Patent [19]

Mattila et al.

[11] Patent Number: 5,619,988

[45] Date of Patent: Apr. 15, 1997

[54] FIRST STAGE PRESSURE REGULATOR FOR EMERGENCY BREATHING APPARATUS

[75] Inventors: Robert J. Mattila; Frank J. Fabin, both of Eagan, Minn.

[73] Assignee: Minnesota Mining and Manufacturing Company, St. Paul, Minn.

[21] Appl. No.: 539,535

[22] Filed: Oct. 5, 1995

[51] Int. Cl.[6] ..... A62B 9/02

[52] U.S. Cl. ..... 128/205.24; 137/316

[58] Field of Search ..... 128/205.24; 137/316; 251/266

[56] References Cited

U.S. PATENT DOCUMENTS

| | | | |
|---|---|---|---|
| 543,448 | 7/1895 | Lowe | 137/495 |
| 1,173,913 | 2/1916 | Anderson | 137/505.2 |
| 1,984,792 | 12/1934 | Ford | 50/23 |
| 2,008,198 | 7/1935 | Beggs | 137/153 |
| 2,528,440 | 10/1950 | Kmiecik | 137/53 |
| 2,674,260 | 4/1954 | Thrush | 137/469 |
| 3,563,268 | 2/1971 | Williams | 251/266 X |
| 4,015,630 | 4/1977 | Contreras | 128/205.24 X |
| 4,114,389 | 9/1978 | Bohmrich et al. | 405/186 |
| 4,178,961 | 12/1979 | Warncke | 137/495 |
| 4,192,298 | 3/1980 | Ferraro et al. | 128/205.24 |
| 4,219,017 | 8/1980 | Shamlian et al. | 128/204.26 |
| 4,284,102 | 8/1981 | Adler | 137/543.21 |
| 4,378,011 | 3/1983 | Warncke et al. | 128/204.26 |
| 4,606,339 | 8/1986 | Walther | 128/204.19 |
| 4,676,268 | 6/1987 | Sano | 137/375 |
| 4,699,170 | 10/1987 | Diephuis et al. | 137/454.5 |
| 4,750,485 | 6/1988 | Bartos | 128/205.24 |
| 4,841,953 | 6/1989 | Dodrill | 128/202.27 |
| 5,070,485 | 12/1991 | Nyce | 367/127 |
| 5,099,835 | 3/1992 | Nelepka | 128/204.18 |

*Primary Examiner*—V. Millin
*Assistant Examiner*—Eric P. Raciti
*Attorney, Agent, or Firm*—Gary L. Griswold; Walter N. Kirn; James A. Rogers

[57] ABSTRACT

A self-registering piston for an pressure regulator that minimizes variability of the target regulated pressure. The pressure regulator valve includes a valve body having a valve seat interposed between an inlet port supplying unregulated pressure and an outlet port. A piston having a piston seat at a first end and a counter-force surface on the second end is positioned to translate axially from an engaged position when a piston seat is engaged with a valve seat and a disengaged position. A biasing mechanism is provided to bias the piston toward the disengaged position. The pressure regulator includes a passageway extending generally from proximate the piston seat to the counter-force surface to couple the counter-force surface with the regulated pressure. The regulated pressure acts on the counter-force surface in opposition to the combination of the unregulated pressure acting on the piston seat, the deformation force necessary to deform the piston seat and achieve an air-tight seal, and the biasing mechanism acting on the piston. A retaining mechanism is provided for releasably retaining the piston seat to the valve seat. A guide mechanism is provided for maintaining a fixed rotational orientation of the piston seat with respect to the valve seat so that a substantially identical rotational orientation is achieved when the piston is removed and reinserted into the valve body.

10 Claims, 5 Drawing Sheets

FIRST STAGE PRESSURE REGULATOR FOR EMERGENCY BREATHING APPARATUS

FIELD OF THE INVENTION

The present invention relates to a first stage pressure regulator for self-contained breathing devices such as an emergency breathing apparatus, and more particularly, to a self-registering piston for an pressure regulator.

BACKGROUND OF THE INVENTION

Portable emergency breathing devices typically include a cylinder of compressed breathing grade air having a cylinder pressure of approximately 20.68 MPa (3000 psi) and a pressure demand supplied air respirator. One or more pressure regulators are required to reduce the unregulated pressure in the cylinder down to some target respirable pressure, such as about 249 Pa (1 inch of water). Where a first and second pressure regulator are utilized, the second stage pressure regulator may be worn by the operator as part of a respirator device.

First stage pressure regulators generally utilize a piston that is allowed to translate axially for engagement and disengagement with a valve seat. The valve seat is typically interposed between the cylinder and the pressure regulator. At one end of the piston is a piston seat frequently made of a compliant material such as polycarbonate or brass that is acted upon by the unregulated pressure. The other end of the piston generally has a surface area which is acted upon by the regulated pressure, so as to force the piston seat against the valve seat to shut off the flow of air when the regulated pressure is achieved. A spring is typically included to bias the piston seat toward the valve seat. Air flows from the cylinder until the pressure on the regulated side of the piston is high enough to generate an adequate force against the piston surface to cause the piston seat to move the piston seat against the valve seat, thereby stopping the flow of air from the cylinder.

Some designs of first stage regulators utilize a rotating knob or other threaded member to force the piston against the valve seat and shut-off the flow of compressed air. The amount of force generated between the piston seat and the valve seat depends on how far the knob is closed. Deformation of the valve seat can occur in some circumstances.

As a result of manufacturing limitations and machining tolerances, the piston, the piston seat, and the valve seats are generally not perfectly aligned axially. Additionally, irregularities in the machining of the valve seat may become imprinted on the piston seat. In the event the regulator is disassembled and reassembled for maintenance, any indentations or deformations on the piston seat may not be precisely realigned with the valve seat. Although the spring force and force on the piston generated by the regulated and unregulated air pressure are known, the force required to form a seal is somewhat unpredictable. As a result of surface imperfections on the piston and valve seats and/or a mismatch between the piston seat and the valve seat, the force required to deform the piston seat and form a seal and shut-off of the flow from the cylinder may be greater than is generated by the target regulated pressure acting on the regulated side of the piston. Consequently, the valve remains open until the regulated pressure is sufficient to form a seal and shut-off the flow of air. The increased force necessary to form a seal can correspond to a regulated pressure and/or a variability of the regulated pressure outside the target regulated pressure range.

SUMMARY OF THE INVENTION

The present invention is directed to a self-registering piston for a pressure regulator that minimizes variability of the target regulated pressure.

The pressure regulator valve includes a valve body having a valve seat interposed between an inlet port supplying unregulated pressure and an outlet port. A piston having a deformable piston seat at a first end and a counter-force surface on the second end is positioned to translate axially from an engaged position when a piston seat is engaged with a valve seat and a disengaged position. A biasing mechanism is provided to bias the piston toward the disengaged position. The pressure regulator includes a passageway extending generally from proximate the piston seat to the counter-force surface to couple the counter-force surface with the regulated pressure. The regulated pressure acts on the counter-force surface in opposition to the combination of the unregulated pressure acting on the piston seat, the deformation force necessary to deform the piston seat and achieve an air-tight seal, and the biasing mechanism acting on the piston. A retaining mechanism is provided for releasably retaining the piston seat to the valve seat. A guide mechanism is provided for maintaining a fixed rotational orientation of the piston seat with respect to the valve seat so that a substantially identical rotational orientation is achieved when the piston is removed and reinserted into the valve body.

In one embodiment, the guide mechanism includes a guide pin connected to the piston perpendicular to the axis of travel and an alignment slot on the valve body parallel to the axis permitting sliding engagement of the guide pin. The alignment slot maintains the rotational orientation of the piston seat with respect to the valve seat. In one embodiment, the alignment slot is located on a hollow cylindrical sleeve arranged concentrically with the axis. O-rings on the piston assist in maintaining the axial alignment of the piston seat with the valve seat. In one embodiment, the biasing mechanism includes a spring arranged concentrically around the axis. Alternatively, the valve seat may be deformable.

In the preferred embodiment, the regulated pressure is maintained in the range of 552 to 689 kPa (80–100 psi), for unregulated pressure in a range of approximately 1.378 to 20.68 MPa (200–3000 psi).

The retaining mechanism is preferably a threaded cap engaged with the valve body proximate the second end of the piston. The retaining mechanism permits the piston seat to be retained against the valve seat to seal the inlet port. In the preferred embodiment, the valve body includes a burst valve, a pressure gauge, a fill port on the unregulated side of the pressure regulator and an air inlet port for receiving an external air supply on the regulated side.

The present invention is also directed to a self-contained breathing apparatus, such as a portable emergency breathing apparatus, utilizing the pressure regulator valve of the present invention. A cylinder is fluidly coupled to the inlet port of the valve body. A hose couples the outlet port of the valve body to a respirator assembly. The respirator assembly may include a second-stage regulator valve and a respirator mask.

In an alternate embodiment, an air supply hose is connected to the pressure regulator valve by a quick-release mechanism. The quick-release mechanism preferably includes a check valve to prevent air in the valve body from being released into the environment if the air supply hose is removed. The air supply hose supplies breathable air from an external air supply to the operator. In the event that the source of breathable air is interrupted or the operator must evacuate the immediate area, the air supply hose can be disconnected from the valve body and the retaining mechanism opened to permit air to be supplied to the operator from the cylinder.

DETAILED DESCRIPTION OF THE PREFERRED EMBODIMENT

Figure 1:
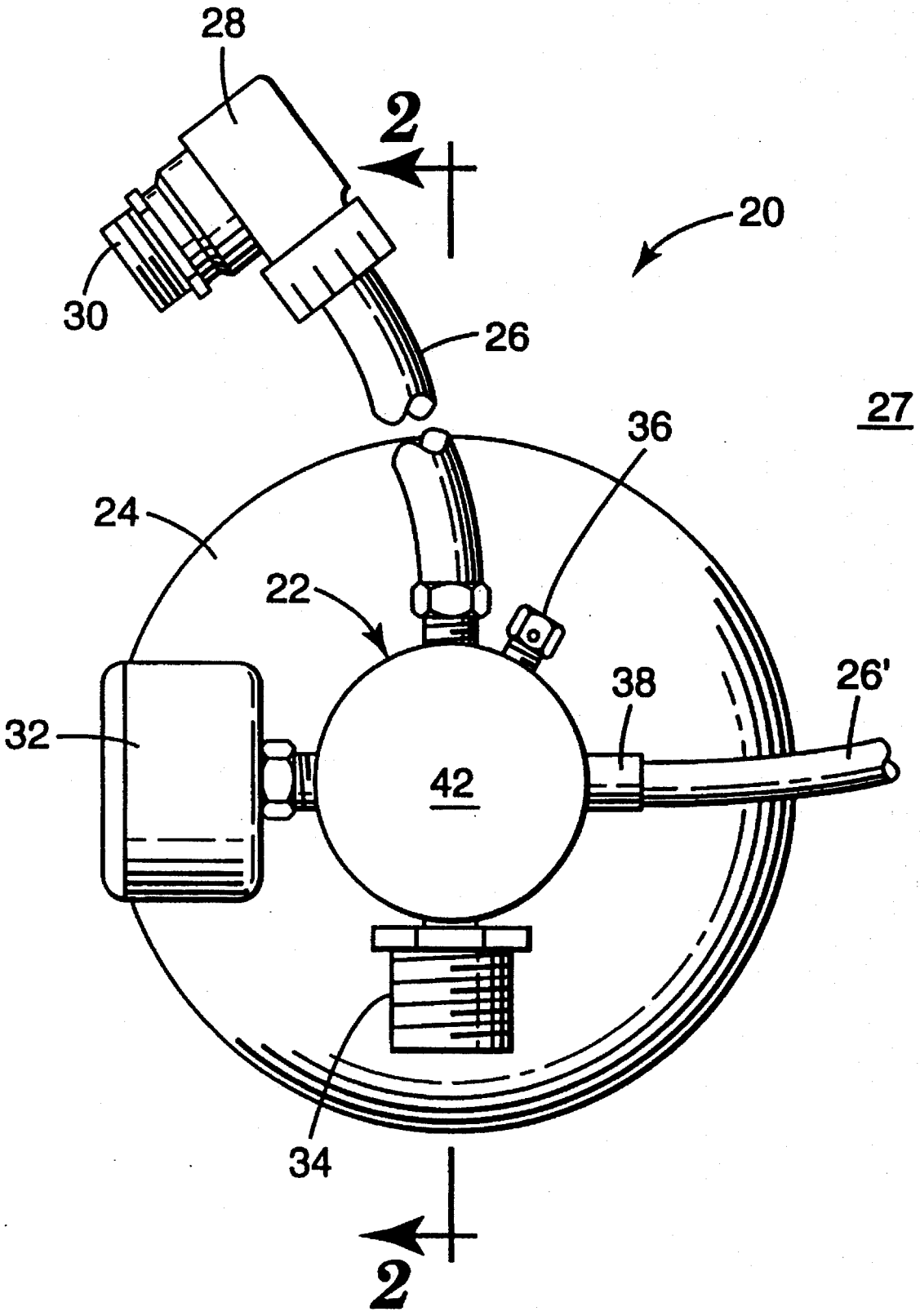
FIG. 1 is a top schematic view of a portable breathing apparatus connected to an external source of pressurized breathing gas.

FIG. 1 illustrates an exemplary portable breathing apparatus 20 in which a first stage regulator 22 reduces unregulated pressure in aluminum cylinder 24 from a range of 15.3–20.68 MPa (2216–3000 psi) down to a target regulated pressure of 0.552 to 0.689 MPa (80–100 psi) at hose 26. In the preferred embodiment, the hose 26 is fluidly connected to a second stage regulator 28 that provides a threaded portion 30 for engagement with a respirator device.

The first stage pressure regulator 22 preferably includes a pressure gauge 32, a fill port 34, a burst valve 36, and a secondary air inlet port 38. The short section of hose 26' connects the regulator 22 to an external source of breathable air (not shown). A quick-disconnect fitting 40 (see FIG. 6) is attached to the end of hose 26'. The fill port 34 preferably includes a check valve (not shown). A quick-disconnect fitting suitable for use in the present invention is available under the designation Hansen industrial interchange from Parker-Hannifier. A check valve (not shown) is also preferably interposed between the air inlet port 38 and the pressure regulator 22 so that pressurized air in the pressure regulator 22 is not released into the external environment 27 if the hose 26' is disconnected from the external air supply.

The burst valve 36 is designed to vent the cylinder to the external environment 27 if the pressure in the cylinder exceeds 20.85–23.16 Mpa (3025–3360 psi) at 71° C. (160° F.) such as my occur if the cylinder is exposed to high temperatures. A suitable burst valve 36 for use in the present invention is available under model number 5302-13 from Thermo Valve, Inc. of Santa Rosa, Calif. The pressure gauge 32 is designed to indicate the pressure in the cylinder 24. A suitable pressure gauge 32 is available under the designation P500 series gauge from U.S. Gauge Division of Ameteck, Inc. of Sellersville, Pa.

When connected to a source of breathable air through the hose 26', the first stage regulator 22 operates as a pass-through to the hose 26 and second stage regulator 28. However, in some circumstances, it may be desirable for the operator to disconnect from the hose 26'. For example, in the event that the external source of breathable air is terminated or the area in which the operator is working needs to be evacuated, the operator can disengage the fitting 40 from the hose 26'. As will be discussed in detail below, a threaded cap 42 is rotated to release breathable grade air from the cylinder 24 to the pressure regulator 22.

Figure 2:
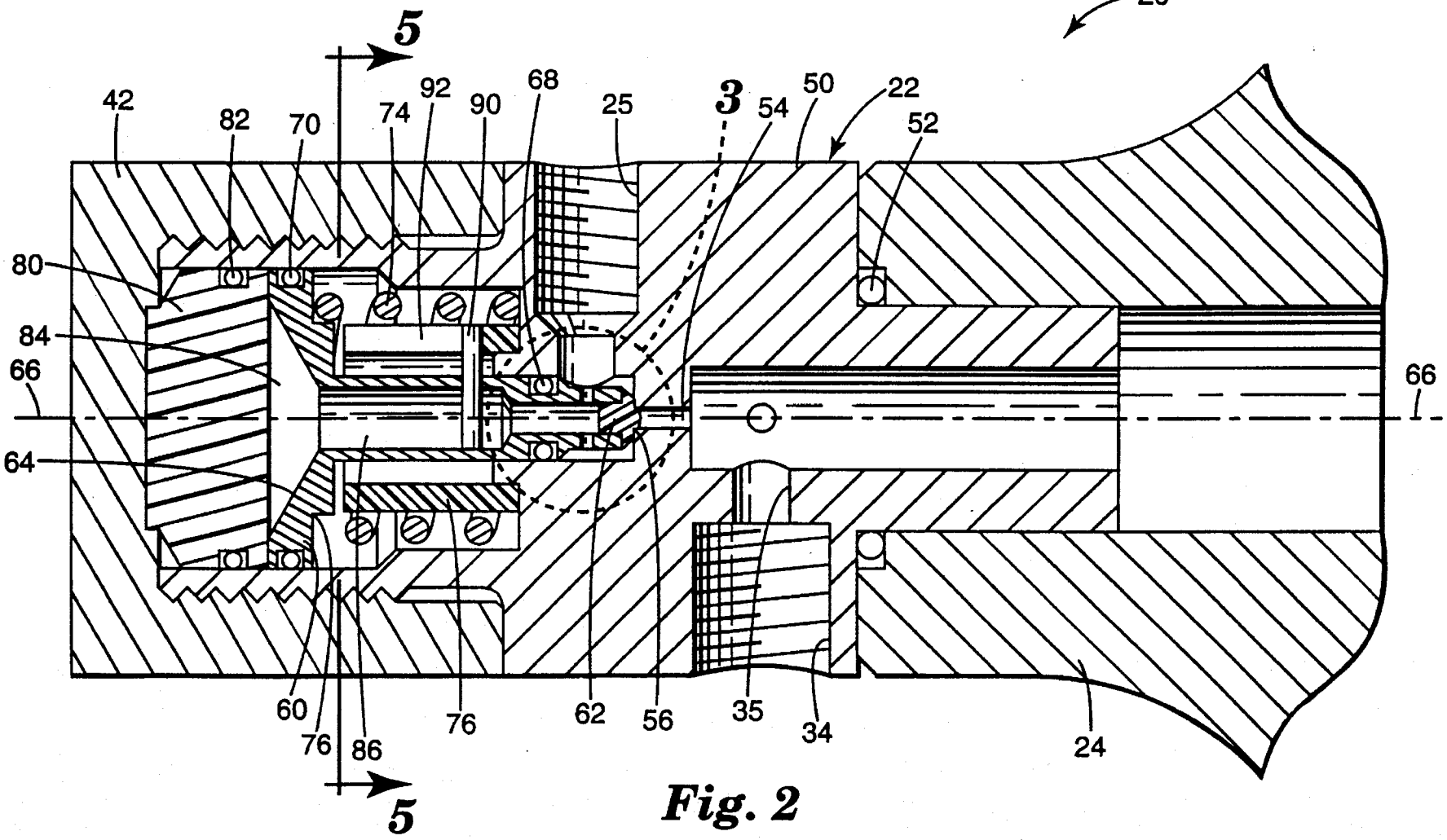
FIG. 2 is a side sectional view of an exemplary pressure regulator valve with a self registering piston.

FIG. 2 is a sectional view of the first stage regulator 22 illustrated in FIG. 1. The cylinder 24 is attached to a valve body 50. A regulator/cylinder O-ring 52 is preferably interposed between the cylinder 24 with the valve body 50. The valve body 50 includes an inlet port 54 proximate a valve seat 56. As is illustrated in FIG. 2, the fill port 34 is fluidly engaged with the inlet port 54 to provide direct access to the cylinder 24. The fill port 34 preferably includes a check valve 35. It will be understood that a variety of check valves, such as a poppet valve may be suitable for this purpose.

Piston 60 includes a piston seat 62 at a first end and a counter-force surface 64 at a second end. The piston seat 62 may be constructed of a variety of materials, such as machining grade polycarbonate or acetal. The piston 60 is positioned within the valve body 50 to permit axial translation along the axis 66. The piston includes a lower piston O-ring 68 proximate the valve seat 56 and an upper piston O-ring 70 proximate the counter-force surface 64.

Figure 4:
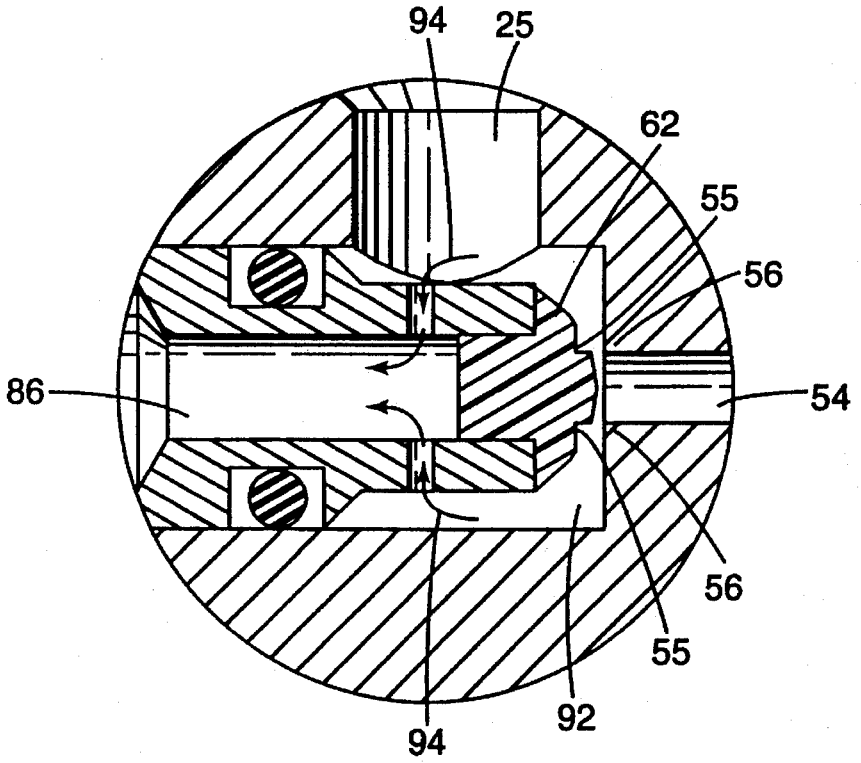
FIG. 4 is a schematic illustration of an exemplary piston seat disengaged from the valve seat.
Figure 5:
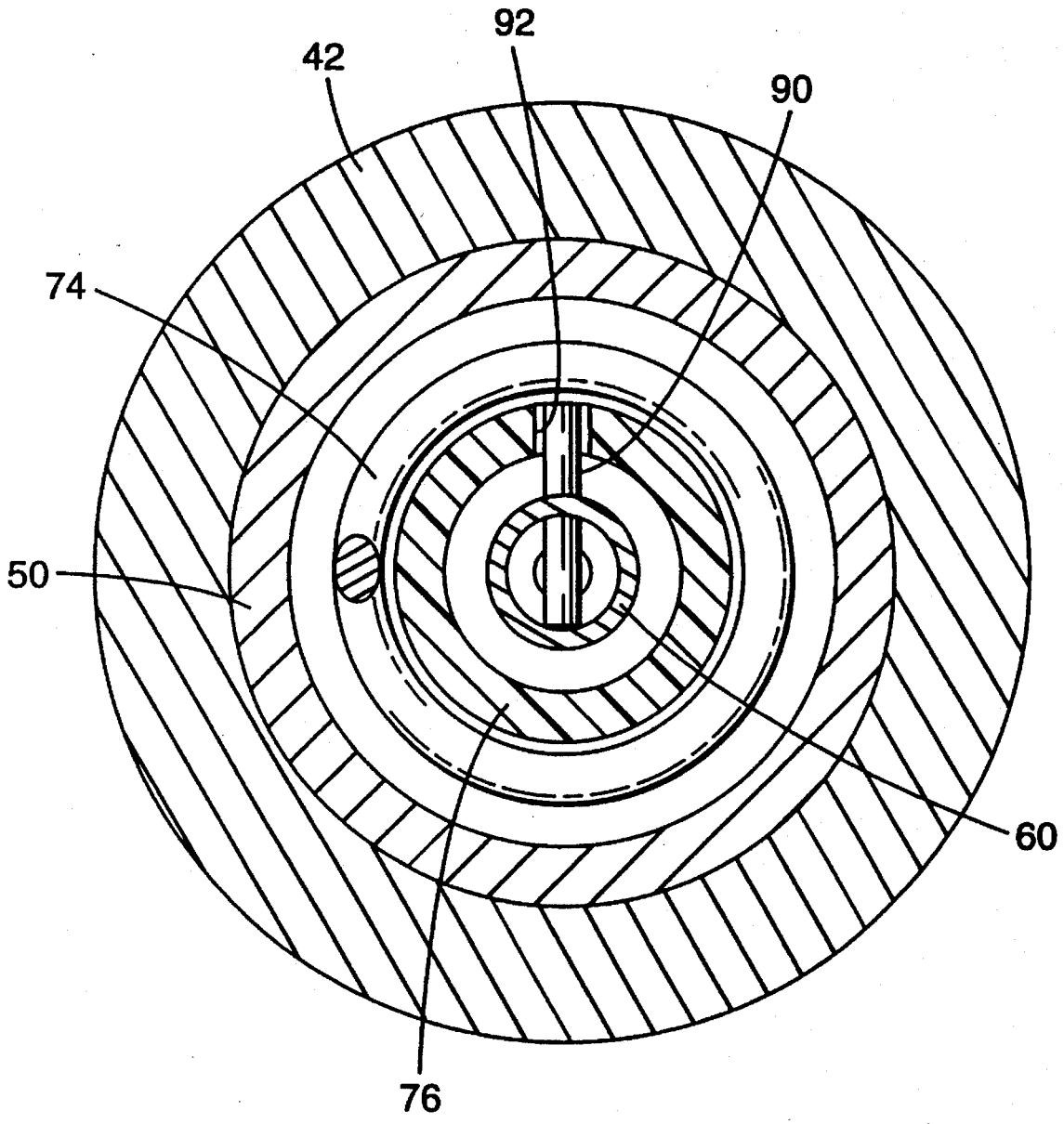
FIG. 5 is a sectional view of the pressure regulator valve of FIG. 2.

As is illustrated in FIG. 1 and the sectional view of FIG. 5, a piston sleeve 72 assists in maintaining the axial alignment of the piston 60 with the valve seat 56 along the axis 66. A spring 74 biases the piston 60 away from the valve seat 56 (see FIG. 4). The spring is preferably constructed of stainless steel. A shoulder 77 on sliding spacer 80 maintains the spring 74 in a generally concentric arrangement with the axis 66. In the preferred embodiment, the piston 60 includes a guide pin 90 which slidably engages with a guide pin slot 92 located in alignment sleeve 76. The guide pin slot 92 is parallel with the axis 66 so as to permit axial translation of the piston 60, while maintaining a constant rotational orientation of the piston seat 62 with respect to the valve seat 56.

Since the spring 74 engages with the valve body 50, the position of the threaded cap 42 does not alter the spring force generated by the spring 74 on the piston 60 during operation of the regulator valve 22. The threaded cap 42 is intended primarily as a shut-off mechanism for the regulator valve 22. During manufacturing, shims may be interposed between the spring 74 and valve body 50 to increase the spring compression force, thereby increasing the regulated pressure from the regulator valve 22.

It will be understood that the rotational orientation of the piston seat 62 with respect to the valve seat 56 may be maintained by a variety of mechanisms. For example, the guide pin 90 may be replaced with corresponding slots and grooves on the piston and piston sleeve or the piston could be constructed with an asymmetrical cross-section that can only engage with the piston sleeve in one orientation. It will be understood that the components of the pressure regulator 22 may be constructed from a variety of materials, such as aluminum, stainless steel, acetal or brass. Suitable materials for constructing the O-rings of the present invention include silicone, ethylene propylene or buna rubber.

The sliding spacer 80 is arranged proximate the counter-force lo surface of the piston 60. The sliding spacer 80 includes a spacer O-ring 82 to retain the regulated pressure in counter-force chamber 84, while still permitting axial translation of the piston 60 along the axis 66. The spacer 80 is retained against the inside surface of the threaded cap 42 by the regulated pressure. The sliding space 80 is preferably constructed of acetal. The threaded cap 42 retains the sliding spacer 80 against the piston 60 and permits the operator to releasably retain the piston seat 62 against the valve seat to prevent the flow of air through the inlet port 54.

As will be discussed in detail below, the piston 60 includes a passageway 86 creating fluid communication between the counter-force chamber 84 and the pressure demand valve port 25. However, it will be understood that a variety of passageway structures may be suitable for fluidly coupling piston chamber 92 to the counter-force chamber 84 and that the present invention is not limited to a passageway in the piston.

Figure 3:
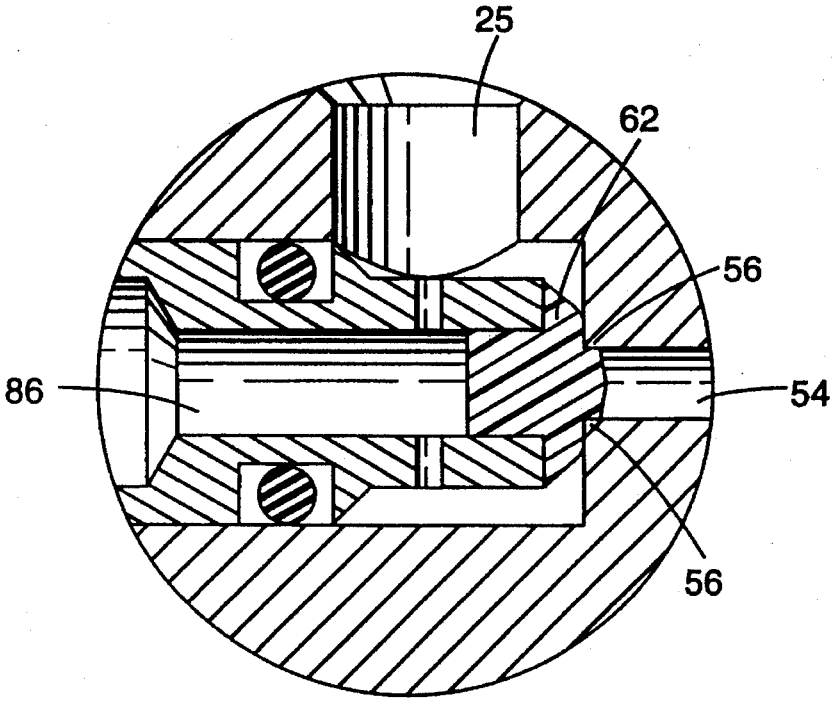
FIG. 3 is a schematic illustration of an exemplary piston seat engaging with a valve seat.

FIG. 3 is a schematic illustration of the piston seat 62 engaged with the valve seat 56 proximate the inlet port 54. In the configuration illustrated in FIG. 3, the inlet port 54 is fluidly sealed from the pressure demand valve port 25. FIG. 4 illustrates the piston seat 62 disengaged from the valve seat 56. The shape of the piston seat 62 has been plastically deformed to include indentations 55 corresponding to the valve seat 56 and inlet port 54 of the first stage regulator 22. In the disengaged configuration illustrated in FIG. 4, pressurized air shown as arrows moves from the inlet port 54 through piston chamber 92 and into the passageway 86 through apertures 94. As discussed above, the passageway 86 is in fluid communication with the counter-force chamber 84 so that the regulated pressure acts on the counter force surface 64. It will be understood that the valve seat 56 may also be deformed. The deformation of the piston seat 62 and/or valve seat 56 may include both a plastic and elastic component.

In operation, the high pressure at the inlet port 54 exerts a lifting force $F_L$ against the piston seat 62. The lifting force $F_L$ combines with the force $F_S$ of the spring 74 and $F_D$ deformation force of the piston seat to move the piston seat 62 to the disengaged position. The deformation force $F_D$ corresponds to the force required to elastically deform the piston seat 62 and form an air-tight seal. The guide pin 90 aligns the piston seat 62 with the valve seat 56 so as to minimize the impact of surface imperfections on the piston and valve seats and/or a mismatches between the piston seat and the valve seat. Consequently, the force required to deform the piston seat and form a seal to shut-off of the flow from the cylinder is more repeatable, even after the regulator valve 22 has been disassembled and reassembled.

Pressurized air enters the piston chamber 92 until the air pressure in the counter-force chamber 84 acting on the counter-force surface 64 generates a counter-force $F_C$ sufficient to overcome the combined forces of the spring force, lifting force and deformation force ($F_S$+$F_L$+$F_D$). The air pressure in the counter-force chamber 84 corresponds to the target regulated pressure presented to the pressure demand valve port 25. In the preferred embodiment, the target regulated pressure is 0.552 to 0.689 MPa (80–100 psi).

The surface area of the piston seat 62 exposed to the unregulated pressure at the inlet port 54 in the cylinder 24 corresponds to a force that is less than the force created by the target regulated pressure acting on the counter-force surface 64 in the counter-force chamber 84. The spring 74 adds an additional biasing force $F_S$ to move the piston seat 62 away from the valve seat 56, toward the disengaged position. Consequently, the regulated pressure present at the pressure demand valve port 25 is not a direct function of the pressure in the cylinder 24. Rather, the regulated pressure is generally proportional to the spring constant of the spring 74. In the preferred embodiment, the surface area of the piston seat 62 exposed to the inlet port 54 is approximately 2.45 $mm^2$ (0.0038 $inches^2$) and the surface area of the counter-force surface 64 is approximately 506.7 $mm^2$ (0.7854 $inches^2$). The spring constant is approximately 750 kg/m (42 lbs/inch).

The pressure regulator 22 requires periodic maintenance for cleaning, oiling, replacement of worn components, such as O-rings. The threaded cap 42 may be unscrewed from the valve body 50 so that the piston 60 can be removed. Upon completion of the maintenance procedure, the piston 60 is reinserted into the valve body 50 so that the guide pin 90 is aligned with the guide pin slot 92 and the rotational orientation of the piston seat 62 with respect to the valve seat 56 prior to removal of the piston 60 is maintained.

Figure 6:
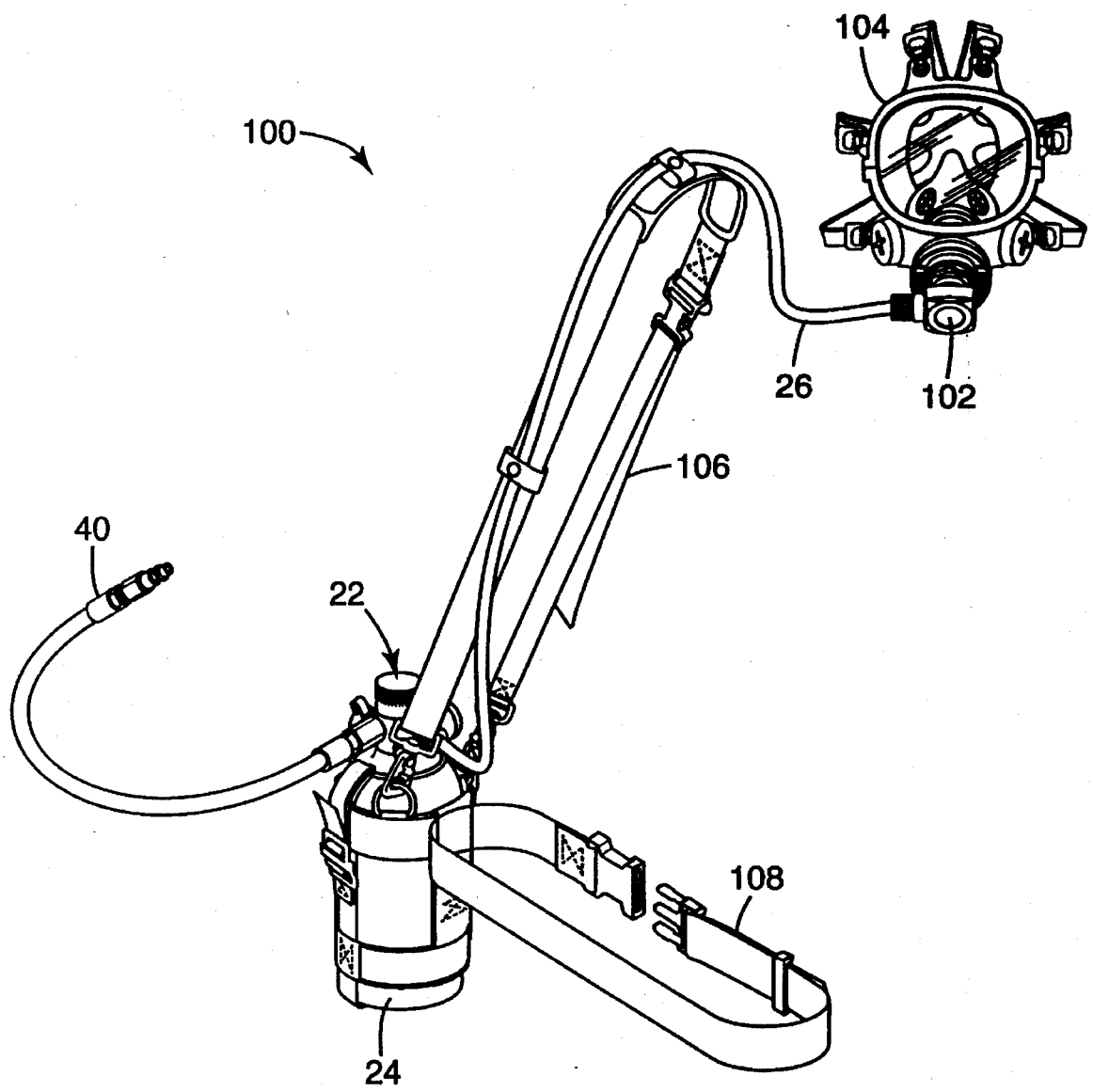
FIG. 6 is a perspective view of an exemplary emergency breathing system.

FIG. 6 is an exemplary portable emergency breathing apparatus system 100 utilizing the pressure regulator 22 of the present invention. The hose 26 is connected to a second stage regulator 102 on a face mask 104. A face piece available from 3M Company, St. Paul, Minn. under model number 7800S Full Facepiece is suitable for use with the present system 100. A shoulder strap 106 and waist strap 108 are provided to retain the cylinder 24 to the operator. The cylinder is constructed of aluminum and contains 0.22 $m^3$ (8 cubic feet) of compressed gas sufficient for about 5 minutes of air for the operator. The hose 26' includes a quick-disconnect fitting 40 for engagement and disengagement with an external source of breathable air (not shown). It will be understood that a variety of face masks may be suitable for use with the present portable emergency breathing apparatus 20, and that the present invention is not limited to the specific embodiments disclosed in FIG. 6. System 100 such as illustrated in FIG. 6 are typically rated for five minutes of service (0.227 $m^3$ of air) and are intended to be used primarily in the event of a failure of the primary air source to escape a dangerous atmosphere.

Although the invention has been described with respect to specific preferred embodiments, it should be appreciated that other embodiments utilizing the concept of the present invention are possible without departing from the scope of the invention. The invention, for example, is not intended to be limited to specific materials, spring constants, surface areas of the piston, or respirator assemblies; rather, the invention is defined by the claims and equivalents thereof.

What is claimed is:

1. A pressure regulator valve with a self-registering piston connectable to a portable air cylinder and an external compressed air source, the pressure regulating valve comprising:

a valve body having a valve seat interposed between an inlet port receiving unregulated air pressure from the portable air cylinder and an outlet port;

a secondary air inlet port on the valve body releasably connectable to the external compressed air source;

a removable piston having a piston seat at a first end and a counter-force surface at a second end, the piston being biased along an axis of travel by the unregulated pressure from an engaged position where the piston seat is engaged with the valve seat and a disengaged position;

biasing means for biasing the piston toward the disengaged position;

a passageway fluidly coupling the counter-force surface with the regulated pressure for biasing the piston toward the engaged position so that a target regulated pressure is maintained; and guide means for maintaining a fixed rotational orientation of the piston seat with respect to the valve seat so that a substantially identical rotational orientation is achieved when the piston is removed and reinserted into the valve body.

2. The apparatus of claim 1 wherein the guide means comprises a guide pin connected to the piston perpendicular to the axis of travel and an alignment slot on the valve body parallel to the axis permitting sliding engagement of the guide pin.

3. The apparatus of claim 1 wherein the guide means comprises a slotted, hollow, cylindrical sleeve arranged concentrically with the axis of travel having an alignment slot.

4. The apparatus of claim 1 wherein the biasing means comprise a spring arranged concentrically around the axis of travel.

5. The apparatus of claim 1 wherein the removable piston is retained in the valve body by a threaded cap engaged with the valve body proximate the second end of the piston.

6. The apparatus of claim 1 wherein the valve body further includes a burst valve, a pressure gauge, and a fill port.

7. The apparatus of claim 1 further comprising a hose coupling the outlet port of the valve body to a respirator assembly.

8. The apparatus of claim 7 wherein the respirator assembly comprises a second stage regulator valve and a respirator mask.

9. A portable breathing apparatus connectable to a portable air cylinder and an external compressed air source, the pressure regulating valve comprising:

a valve body having a valve seat interposed between an inlet port receiving unregulated air pressure and an outlet port;

a cylinder fluidly coupled to the inlet port of the valve body for supplying unregulated pressure;

a secondary air inlet port on the valve body releasably connectable to the external compressed air source;

a removable piston having a piston seat at a first end and a counter-force surface at a second end, the piston being biased along an axis of travel by the unregulated pressure from an engaged position where the piston seat is engaged with the valve seat and a disengaged position;

biasing means for biasing the piston toward the disengaged position;

a passageway fluidly coupling the counter-force surface with the regulated pressure for biasing the piston toward the engaged position so that a target regulated pressure is maintained;

guide means for maintaining a fixed rotational orientation of the piston seat with respect to the valve seat so that a substantially identical rotational orientation is achieved when the piston is removed and reinserted into the valve body; and a hose coupling the outlet port of the valve body to a respirator assembly.

10. The apparatus of claim 9 wherein the valve body further includes a burst valve, a pressure gauge, and a fill port.

* * * * *